US012583699B2

(12) United States Patent
Hamada

(10) Patent No.: US 12,583,699 B2
(45) Date of Patent: Mar. 24, 2026

(54) PRINTING APPARATUS

(71) Applicant: SEIKO EPSON CORPORATION, Tokyo (JP)

(72) Inventor: Nobuhiko Hamada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/423,004

(22) Filed: Jan. 25, 2024

(65) Prior Publication Data

US 2024/0253925 A1 Aug. 1, 2024

(30) Foreign Application Priority Data

Jan. 27, 2023 (JP) ..... 2023-010789

(51) Int. Cl.

| | |
|---|---|
| ***B41J 15/16*** | (2006.01) |
| ***B41J 2/01*** | (2006.01) |
| ***B65H 16/00*** | (2006.01) |
| ***B65H 18/08*** | (2006.01) |

(52) U.S. Cl.

CPC ..... *B65H 16/005* (2013.01); *B65H 18/08* (2013.01); *B65H 2301/517* (2013.01)

(58) Field of Classification Search

None

See application file for complete search history.

(56) References Cited

U.S. PATENT DOCUMENTS

2006/0238592 A1* 10/2006 Kadomatsu ..... B41J 11/007 347/100
2010/0110156 A1* 5/2010 Hara ..... B41J 11/00222 347/102
2016/0332462 A1 11/2016 Harayama
2019/0061379 A1* 2/2019 Saito ..... B41J 2/475
2022/0281234 A1* 9/2022 Yoshinaga ..... B65H 7/02

FOREIGN PATENT DOCUMENTS

JP 2016-215428 A 12/2016
WO WO-2015119615 A1 * 8/2015 ..... B41J 11/0015

* cited by examiner

*Primary Examiner* — Leslie J Evanisko
(74) *Attorney, Agent, or Firm* — WORKMAN NYDEGGER

(57) ABSTRACT

A printing apparatus includes: a feeding portion configured to feed a medium from a roll; a transport unit configured to transport the fed medium along a transport path; a printing unit configured to discharge a liquid on the medium; an air blowing unit disposed downstream of the printing unit in the transport path and configured to blow air toward the medium; and a control unit configured to control blowing air by the air blowing unit, in which the air blowing unit includes a fan configured to generate airflow and a case configured to accommodate the fan, the case includes a blow port open toward the transport path, and after the printing unit starts printing on the medium and a leading end of the medium reaches an overlapping region that overlaps with the blow port as viewed toward air blown from the blow port, the control unit starts driving the fan.

6 Claims, 11 Drawing Sheets

PRINTING APPARATUS

The present application is based on, and claims priority from JP Application Serial Number 2023-010789, filed on Jan. 27, 2023, the disclosure of which is hereby incorporated by reference herein in its entirety.

BACKGROUND

1. Technical Field

The present disclosure relates to a printing apparatus.

2. Related Art

JP-A-2016-215428 discloses a printing apparatus including a blowing device used to dry ink discharged onto a medium. The blowing device blows air along a transport path and toward the medium that is being transported.

In a case of the printing apparatus described in JP-A-2016-215428, the leading end of the medium may be lifted from the transport path due to airflow resulting from the blowing device. As the leading end of the medium is lifted, there may occur a situation in which the medium is not correctly transported.

SUMMARY

A printing apparatus includes a feeding portion configured to feed a medium from a roll around which the medium is wound, a transport unit configured to transport, along a transport path, the medium fed from the feeding portion, a printing unit opposed from the transport path downstream of the feeding portion in the transport path and configured to discharge a liquid toward the medium to perform printing on the medium, an air blowing unit disposed downstream of the printing unit in the transport path and configured to blow air toward the medium, and a control unit configured to control blowing air by the air blowing unit, in which the air blowing unit includes a fan configured to generate airflow and a case configured to accommodate the fan, the case includes a blow port open toward the transport path, and after the printing unit starts printing on the medium and a leading end of the medium fed from the feeding portion reaches an overlapping region that overlaps with the blow port as viewed toward air blown from the blow port, the control unit starts driving the fan.

DESCRIPTION OF EMBODIMENTS

Figure 1:
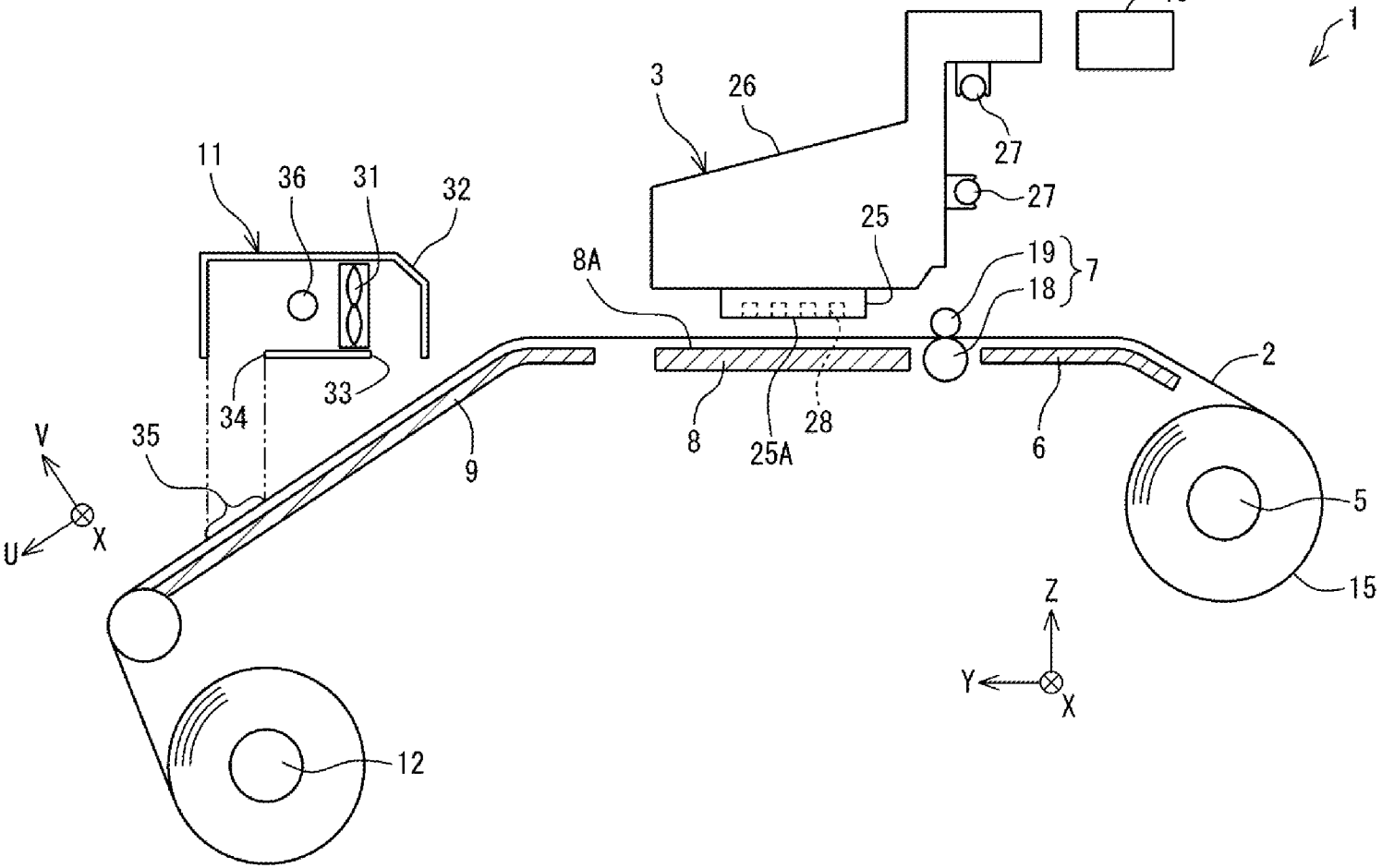
FIG. 1 is a schematic cross-sectional view illustrating the configuration of a printing apparatus.

The printing apparatus 1 illustrated in FIG. 1 is, for example, an ink jet-type printer configured to discharge ink serving as one example of a liquid to a transported medium 2 such as a sheet to print an image of a letter, a photo, or the like on the medium 2. The printing apparatus 1 includes a printing unit 3. The printing unit 3 is configured to cause ink to be attached on the medium 2 to perform printing. The printing unit 3 is of a serial type configured to perform printing while reciprocating in the width direction of the medium 2. The printing unit 3 may be configured as a line type provided over the width direction of the medium 2.

The X-axis, the Y-axis, and the Z-axis are illustrated in FIG. 1. The X-axis, the Y-axis, and the Z-axis are coordinate axes perpendicular to each other. In FIG. 1 and the following drawings, the X-axis, the Y-axis, and the Z-axis are also illustrated on an as-necessary basis. In this case, the X-axis, the Y-axis, and the Z-axis in each of the drawings correspond to the X-axis, the Y-axis, and the Z-axis in FIG. 1, respectively. FIG. 1 illustrates a state in which the printing apparatus 1 is disposed at an X-Y plane defined by the X-axis and the Y-axis. In the present embodiment, a usage state of the printing apparatus 1 represents a state in which the printing apparatus 1 is disposed at the X-Y plane in a state in which the X-Y plane matches a horizontal flat surface. The posture of the printing apparatus 1 when the printing apparatus 1 is disposed at the X-Y plane that matches the horizontal surface is referred to as a usage posture of the printing apparatus 1.

In the following description, when the X-axis, the Y-axis, and the Z-axis are illustrated in the drawing or described in relation to a constituent component or unit of the printing apparatus 1, the X-axis, the Y-axis, and the Z-axis indicate axes in a state in which the constituent component or unit is installed in the printing apparatus 1. In addition, the posture of the constituent component or unit of the printing apparatus 1 at the usage posture is referred to a usage posture of the constituent component or unit. In addition, in the following description concerning the printing apparatus 1 or its constituent component or unit or the like, such a description is made on the assumption that the printing apparatus 1 or its constituent component or unit or the like is disposed at the usage posture.

Note that, in a situation where the printing apparatus 1 is actually used, it is only necessary that the horizontal surface is a surface that is substantially horizontal. This substantial horizon includes, for example, a slope that falls within a range of slope permitted for the surface where the printing apparatus 1 is disposed when in use. Thus, the substantially horizontal surface is not limited, for example, to a highly precisely formed surface such as a machine plate. The substantially horizontal surface includes, for example, various types of surfaces of a desk, a stage, a shelf, a floor, or the like at which the printing apparatus 1 is disposed when in use. In addition, the vertical direction is not limited to the exact gravitational direction, and includes a direction perpendicular to the substantially horizontal surface. Thus, when the substantially horizontal surface is, for example, a surface of a desk, a stage, a shelf, a floor, or the like, the vertical direction represents the direction perpendicular to these surfaces.

An arrow is attached to each of the X-axis, the Y-axis, and the Z-axis. In each of the X-axis, the Y-axis, and the Z-axis, the arrowed direction indicates a direction of + (positive), and a direction opposite from the arrowed direction indicates a direction of − (negative). The Z-axis is an axis perpendicular to the X-Y plane. In the usage state of the printing apparatus 1, the +Z direction is a vertically upward direction. In the usage state of the printing apparatus 1, the −Z direction is a vertically downward direction in FIG. 1. Note that the printing unit 3 reciprocates along the X-axis. Thus, the X-axis is defined as a direction in which the printing unit 3 reciprocates.

As illustrated in FIG. 1, the printing apparatus 1 includes a feeding shaft 5, a first support portion 6, a transport unit 7, a second support portion 8, a third support portion 9, a blowing device 11, a winding shaft 12, and a controlling unit 13. The feeding shaft 5 is a rod-shaped member extending along the X-axis, and is supported at both ends thereof in the ±X direction by a frame or the like that is not illustrated. The feeding shaft 5 rotatably supports a roll 15 around which a long-length medium 2 is repeatedly wound in a tubular shape. By rotating, the feeding shaft 5 feeds the medium 2 from the roll 15 toward the first support portion 6. The feeding shaft 5 serves as one example of a feeding portion.

The first support portion 6, the second support portion 8, and the third support portion 9 are members each configured to support the long-length medium 2 transported in the transport direction. The medium 2 is transported along the front surfaces of the first support portion 6, the second support portion 8, and the third support portion 9. The direction along the front surfaces of the first support portion 6, the second support portion 8, and the third support portion 9 is the transport direction of the medium 2. The transport direction intersects the X-axis. The first support portion 6, the second support portion 8, and the third support portion 9 are fixed at a frame or the like (not illustrated in the drawing) that is configured to support the entire printing apparatus 1.

The first support portion 6 supports a portion of the medium 2 that is disposed upstream, in the transport direction, of a portion that is opposed from the printing unit 3. In many cases, the first support portion 6 supports a portion of the medium 2 before being printed by the printing unit 3. The second support portion 8 is disposed downstream of the first support portion 6 in the transport direction. The medium 2 supported by the first support portion 6 is transported by the transport unit 7 to the second support portion 8. The transport unit 7 is disposed downstream of the first support portion 6 in the transport direction. In addition, the transport unit 7 is disposed upstream of the second support portion 8 in the transport direction.

The transport unit 7 includes a first roller 18 and a second roller 19. The first roller 18 and the second roller 19 each extend along the X-axis. The transport unit 7 includes a motor that is not illustrated in the drawing. Power from the motor is transmitted to the first roller 18. The first roller 18 is able to rotate with the power from the motor. The medium 2 is interposed between the first roller 18 and the second roller 19. By rotating the first roller 18 in a state in which the medium 2 is interposed between the first roller 18 and the second roller 19, it is possible to transport the medium 2. The transport unit 7 transports the medium 2 toward the second support portion 8.

In the printing apparatus 1, the first roller 18 serves as a driving roller whereas the second roller 19 serves as a driven roller. The driving roller is driven and rotate with the power from the motor. The driven roller follows the driving and rotation of the driving roller. However, it does not matter whether either of the first roller 18 and the second roller 19 is the driving roller or the driven roller. Note that interposing the medium 2 between the first roller 18 and the second roller 19 is also referred to as "nip". In the printing apparatus 1, by moving the second roller 19 away from the first roller 18, it is possible to release nipping of the medium 2 using the first roller 18 and the second roller 19.

In the printing apparatus 1, by lifting the second roller 19 relative to the first roller 18, it is possible to release nipping. By causing the second roller 19 to descend from a state in which nipping is released, it is possible to change into a nipping state. The nipping state and the nipping released state are independent of the presence or absence of the medium 2. In other words, the state in which the second roller 19 is lifted relative to the first roller 18 is the nipping released state, regardless of the presence or absence of the medium 2. Similarly, the state in which the second roller 19 is caused to descend from the nipping released state is the nipping state, regardless of the presence or absence of the medium 2. For example, when a new roll 15 is set at the feeding shaft 5, nipping is released in order to cause the leading end of the medium 2 fed from the roll 15 to pass through between the first roller 18 and the second roller 19.

The second support portion 8 is disposed at the −Z direction of the printing unit 3. The second support portion 8 is opposed from the printing unit 3. The second support portion 8 supports a portion of the medium 2 on which printing is performed by the printing unit 3. A support face 8A serving as a surface that faces the +Z direction of the second support portion 8 is substantially horizontal. The second support portion 8 is able to apply suction force to the medium 2. A surface of the second support portion 8 that is opposed from the printing unit 3 is flat. The support face 8A of the second support portion 8 extends over a region on which printing can be performed by the printing unit 3. A plurality of suction holes are formed in the support face 8A of the second support portion 8. By drawing air from the plurality of suction holes using a suction fan, it is possible to draw the medium 2 to the support face 8A of the second support portion 8. The second support portion 8 is also called a suction platen.

The printing unit 3 includes a discharging head 25, a carriage 26, and a guide shaft 27. A plurality of nozzles 28 configured to discharge ink are formed in the discharging head 25. The plurality of nozzles 28 are opened at a nozzle surface 25A of the discharging head 25. The guide shaft 27 is a rod-shaped member extending along the X-axis, and is supported at both end portions in the ±X direction by a frame or the like that is not illustrated in the drawing. The guide shaft 27 guides the movement of the carriage 26. The carriage 26 holds the discharging head 25, and causes the discharging head 25 to reciprocate in the ±X direction along the guide shaft 27 with the driving of a driving mechanism that is not illustrated in the drawing. The discharging head 25 is configured to discharge ink toward the medium 2 while moving, to perform printing on the medium 2. In the printing apparatus 1, ink is causes to be discharged from the discharging head 25 toward a region of the medium 2 that overlaps with the second support portion 8, to perform printing.

Note that the state in which the second support portion 8 is opposed from the printing unit 3 represents a state in which the support face 8A of the second support portion 8 is directed toward the nozzle surface 25A of the discharging head 25. The state in which the support face 8A is directed toward the nozzle surface 25A is not limited to the state in which the support face 8A and the nozzle surface 25A are opposed from each other in parallel. On the assumption that there is a region in which the nozzle surface 25A and the support face 8A overlap with each other when the nozzle surface 25A is projected on the support face 8A along a direction in which ink is discharge from the nozzles 28, the support face 8A is in a state of being directed toward the nozzle surface 25A.

The medium 2 is transported at the support face 8A of the second support portion 8 in the +Y direction. The medium 2 is transported from the second support portion 8 toward the third support portion 9. The third support portion 9 is disposed downstream of the second support portion 8 in the transport direction. The third support portion 9 supports a portion of the medium 2 that is disposed downstream, in the transport direction, of a portion that is opposed from the printing unit 3. In many cases, the third support portion 9 supports a portion of the medium 2 after being printed by the printing unit 3.

The winding shaft 12 is disposed downstream of the printing unit 3 in the transport direction. The winding shaft 12 winds the transported medium 2. The winding shaft 12 is disposed downstream of the third support portion 9 in the transport direction. In the printing apparatus 1, the winding shaft 12 is disposed at the −Z direction of the printing unit 3. The third support portion 9 guides the medium 2 toward the winding shaft 12. The third support portion 9 is sloped. The third support portion 9 is sloped toward the +Y direction so as to be directed toward the −Z direction. The medium 2 on which printing has been performed by the printing unit 3 is transported along the third support portion 9 in an oblique direction having the +Y component and the −Z component, and then is wound by the winding shaft 12. The winding shaft 12 serves as one example of a winding unit.

Hereinafter, a U-axis represents a coordinate axis intersecting the X-axis and extending along a direction in which the third support portion 9 is sloped, and a V-axis represents a coordinate axis intersecting the X-axis and the U-axis. Specifically, the X-axis, the U-axis, and the V-axis are perpendicular to each other. In addition, of directions parallel to the U-axis, a +U direction represents the transport direction of the medium 2 in which the medium is transported along the front surface of the third support portion 9, and a −U direction represents an opposite direction from this +U direction. In addition, of directions parallel to the V-axis, a +V direction represents a direction in which the medium 2 is disposed as viewed from the third support portion 9, and a −V direction represents an opposite direction from this +V direction.

Note that, in the drawings, the medium 2 is illustrated so as to be spaced apart from the first support portion 6, the second support portion 8, and the third support portion 9. However, the medium 2 comes into contact with the first support portion 6, the second support portion 8, and the third support portion 9, and is transported so as to slide on the front surfaces of the first support portion 6, the second support portion 8, and the third support portion 9. In the printing apparatus 1, the transport path of the medium 2 represents a path extending from the feeding shaft 5 through the first support portion 6, the second support portion 8, and the third support portion 9 and reaching the winding shaft 12.

The blowing device 11 is disposed downstream of the printing unit 3 in the transport direction. The blowing device 11 is disposed at the +Z direction of the third support portion 9. The blowing device 11 is opposed from the transport path. The blowing device 11 serves as one example of an air blowing unit. The blowing device 11 includes a fan 31 and a case 32. The fan 31 rotates with the power from a motor that is not illustrated in the drawing. The fan 31 rotates to generate airflow. For the fan 31, it may be possible to use, for example, a propeller fan, a sirocco fan, a turbo fan, or the like. The fan 31 is accommodated in the case 32. The case 32 includes a suction port 33 and a blow port 34. The suction port 33 and the blow port 34 are each opened toward the transport path. In other words, it can be said that the suction port 33 and the blow port 34 are each opposed to the transport path.

Within the case 32, the fan 31 is disposed between the suction port 33 and the blow port 34. As the fan 31 rotates with the power from a motor, air comes into the inside of the case 32 from the suction port 33 while air within the case 32 flows out from the blow port 34. The case 32 serves as a flow path for airflow in the blowing device 11. Thus, it may be possible to express that the case 32 is a duct of the blowing device 11. As the fan 31 rotates, the blowing device 11 blows air from the blow port 34 of the case 32 toward the transport path. When the medium 2 is located at the third support portion 9, the blowing device 11 blows air from the blow port 34 of the case 32 toward the medium 2.

The "blow port 34 is opposed from the transport path" means a state in which the blow port 34 is opened toward the transport path. The state in which the blow port 34 is opened toward the transport path is not limited to a state in which the blow port 34 and the transport path are opposed from each other in parallel. On the assumption that there is a region in which the opening area of the blow port 34 and the transport path overlap with each other as viewed from air blown from the blow port 34, the blow port 34 is in a state of being directed toward the transport path. In the printing apparatus 1, a direction of air blown from the blow port 34 is the −Z direction. In the printing apparatus 1, the blow port 34 is opened toward the third support portion 9. In other words, in the printing apparatus 1, when the medium 2 is located at the third support portion 9, the blow port 34 is opposed from the medium 2. In the printing apparatus 1, a region of the transport path that overlaps with the opening area of the blow port 34 as viewed from air blown from the blow port 34 is referred to as an overlapping region 35.

The blowing device 11 is supported by a frame or the like that is not illustrated in the drawing. The blowing device 11 blows air toward the medium 2. The blowing device 11 blows air to the medium 2 on which ink has been discharged, which makes it possible to accelerate drying of the ink attached on the medium 2. The blowing device 11 extends the entire region, in the width direction, of the medium 2 along the X-axis. It may be possible to employ a configuration in which the blowing device 11 includes a heating unit 36. The heating unit 36 is disposed within the case 32. Within the case 32, the heating unit 36 is disposed between the blow port 34 and the fan 31.

The heating unit 36 is configured with a long-length heat generating element such as a heater tube. The heating unit 36 extends along the X-axis, and is configured to heat the air within the case 32. With the heating unit 36 heating the air within the case 32, the air blown from the blow port 34 has a high temperature, as compared with the air that comes in from the suction port 33. With the configuration in which the blowing device 11 includes the heating unit 36, it is possible to further accelerate drying of the ink attached on the medium 2. Note that the heat generating element that constitutes the heating unit 36 is not limited to the heater tube, and it may be possible to use an electrically heated wire, a heat source lamp, or the like. In addition, the heating unit 36 is not limited to the configuration comprised only of one long-length heat generating element. It may be possible to employ a configuration in which a plurality of heat generating elements are arrayed along the X-axis. Furthermore, the heating unit 36 may be disposed between the fan 31 and the suction port 33. Note that it may be possible to employ a configuration in which the blowing device 11 does not include the heating unit 36, or a configuration in which the third support portion 9 is heated.

Figure 2:
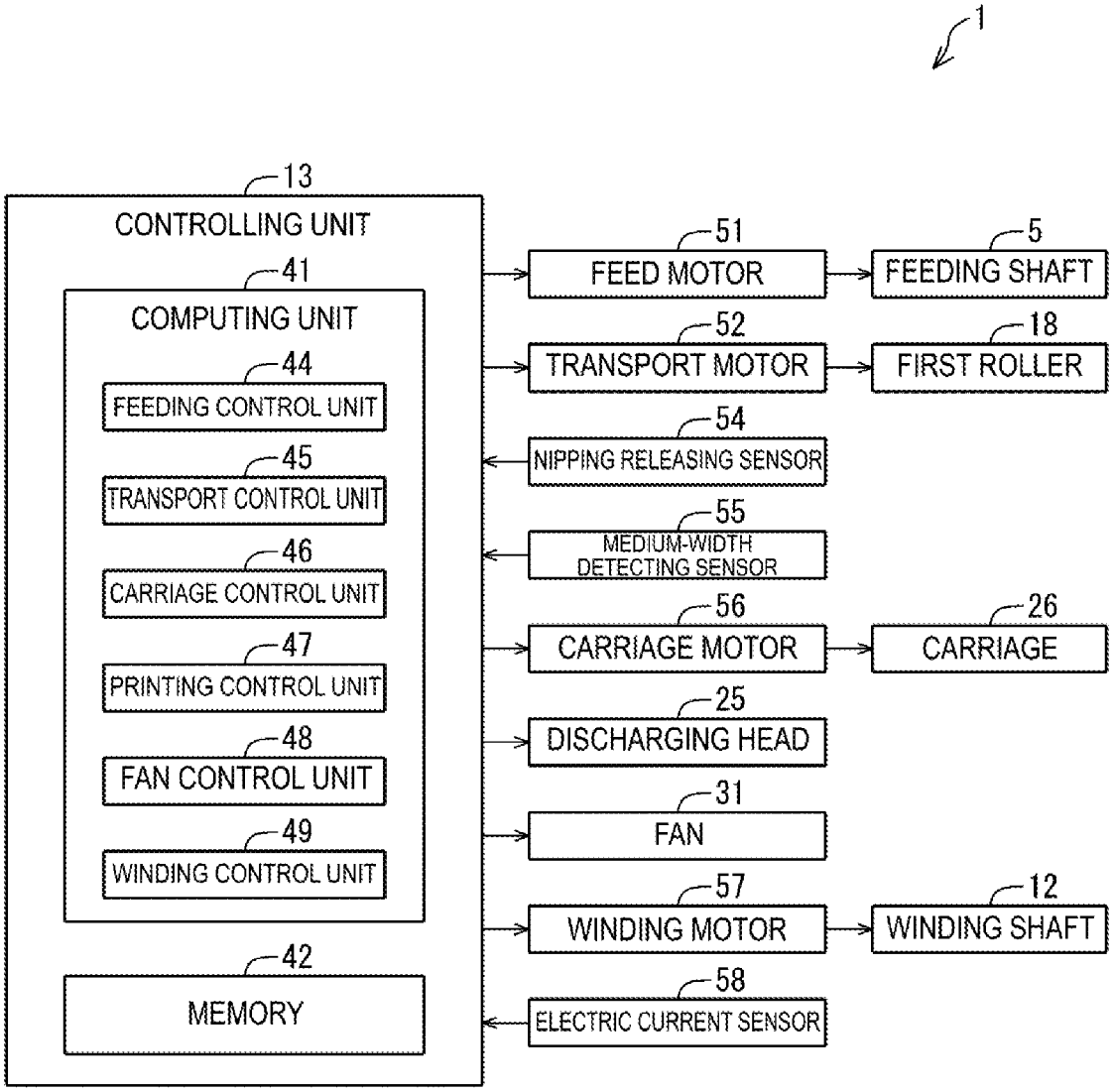
FIG. 2 is a block diagram used to explain the configuration of the printing apparatus.

The controlling unit 13 is a controller configured to control the printing apparatus 1. The controlling unit 13 includes a computing unit 41 and a memory 42, as illustrated in FIG. 2. The computing unit 41 serves as one example of a control unit. The computing unit 41 is a processor including a central processing unit (CPU) or a micro processing unit (MPU), as one example. The controlling unit 13 executes a control program stored in the memory 42 to collectively control operations of the printing apparatus 1. The memory 42 includes a random access memory (RAM), a read only memory (ROM), or the like. The RAM functions as a work area for the computing unit 41. The RAM is used to temporarily hold various types of control programs or various types of data or the like. The ROM holds a control program used to control operations of the printing apparatus 1, various types of setting information, or the like.

The computing unit 41 executes a control program held in the memory 42, thereby functioning as various types of functional units. The computing unit 41 includes, as functional units, a feeding control unit 44, a transport control unit 45, a carriage control unit 46, a printing control unit 47, a fan control unit 48, and a winding control unit 49. The computing unit 41 executes a control program, thereby functioning as the feeding control unit 44, the transport control unit 45, the carriage control unit 46, the printing control unit 47, the fan control unit 48, and the winding control unit 49.

In addition, the printing apparatus 1 includes a feed motor 51, a transport motor 52, a nipping releasing sensor 54, a medium-width detecting sensor 55, a carriage motor 56, a winding motor 57, and an electric current sensor 58. The feed motor 51 generates power used to drive the feeding shaft 5. The transport motor 52 generates power used to drive the first roller 18. The nipping releasing sensor 54 detects a state in which nipping of the first roller 18 and the second roller 19 is released. For the nipping releasing sensor 54, it may be possible to employ an optical sensor such as a photo-sensor, a mechanical switch such as a micro-switch, or various types of sensors. A result of detection by the nipping releasing sensor 54 is transmitted to the computing unit 41. The computing unit 41 restricts operations of the printing apparatus 1 on the basis of the result of detection by the nipping releasing sensor 54. For example, when an instruction of printing is received from a user in a state in which nipping is released, the computing unit 41 stops performing a printing process.

The medium-width detecting sensor 55 detects a width size, along the X-axis, of the medium 2 transported by the transport unit 7. For the medium-width detecting sensor 55, it may be possible to employ an optical sensor such as a photo-sensor, a mechanical switch such as a micro-switch, or various types of sensors. A result of detection by the medium-width detecting sensor 55 is transmitted to the computing unit 41. The computing unit 41 restricts operations of the printing apparatus 1 on the basis of the result of detection by the medium-width detecting sensor 55. For example, when there is a difference between the size of the medium 2 in a print job instructed from a user and the result of detection by the medium-width detecting sensor 55, the computing unit 41 stops performing a printing process. The result of detection by the medium-width detecting sensor 55 includes a result of detection as to whether or not the medium 2 exists at the support face 8A of the second support portion 8. When the medium 2 does not exist at the support face 8A, the medium-width detecting sensor 55 transmits, to the computing unit 41, a result of detection indicating that the medium 2 does not exists at the support face 8A.

The carriage motor 56 generates power used to drive the carriage 26. The winding motor 57 generates power used to drive the winding shaft 12. The electric current sensor 58 detects an electric current value of the winding motor 57. For the electric current sensor 58, it may be possible to use various types of sensors such as a resistance type or a magnetic-field detection type.

The feeding control unit 44 controls driving of the feed motor 51, thereby controlling rotation of the feeding shaft 5. The transport control unit 45 controls driving of the transport motor 52, thereby controlling rotation of the first roller 18. The carriage control unit 46 controls driving of the carriage motor 56, thereby controlling driving of the carriage 26. The printing control unit 47 controls driving of the discharging head 25, thereby controlling discharge of ink from the nozzles 28. The fan control unit 48 controls driving of the fan 31, thereby controlling blowing of air from the blow port 34. The winding control unit 49 controls driving of the winding motor 57, thereby controlling rotation of the winding shaft 12.

In the printing apparatus 1 having the configuration described above, printing is performed on the medium 2 on the basis of a print job designated by a user. The print job is a collection of data used to cause the printing apparatus 1 to perform one printing operation. The print job is a printing instruction instructed by a user. The print job includes print data used to give an instruction concerning a character or an image that should be printed on the medium 2. In addition, the print job includes setting data used to designate a type or size of the medium 2, a region on which printing based on the print data is performed, or the like. When the printing apparatus 1 receives the print job, the computing unit 41 executes a control program on the basis of the print job to perform printing on the medium 2.

When the printing apparatus 1 receives the print job, the computing unit 41 controls driving of the transport motor 52, the carriage motor 56, and the discharging head 25 on the basis of the print data. Thus, in the printing apparatus 1, printing based on the print job is performed by discharging ink from the discharging head 25 while intermittently transporting the medium 2 in the transport direction and moving the carriage 26 along the X-axis. Note that, in the printing apparatus 1, before printing starts, it is checked that the apparatus is in the nipping state, on the basis of a result of detection by the nipping releasing sensor 54. In addition, in the printing apparatus 1, before printing starts, it is checked that the size of the medium 2 matches the setting data, on the basis of a result of detection by the medium-width detecting sensor 55.

Figure 3:
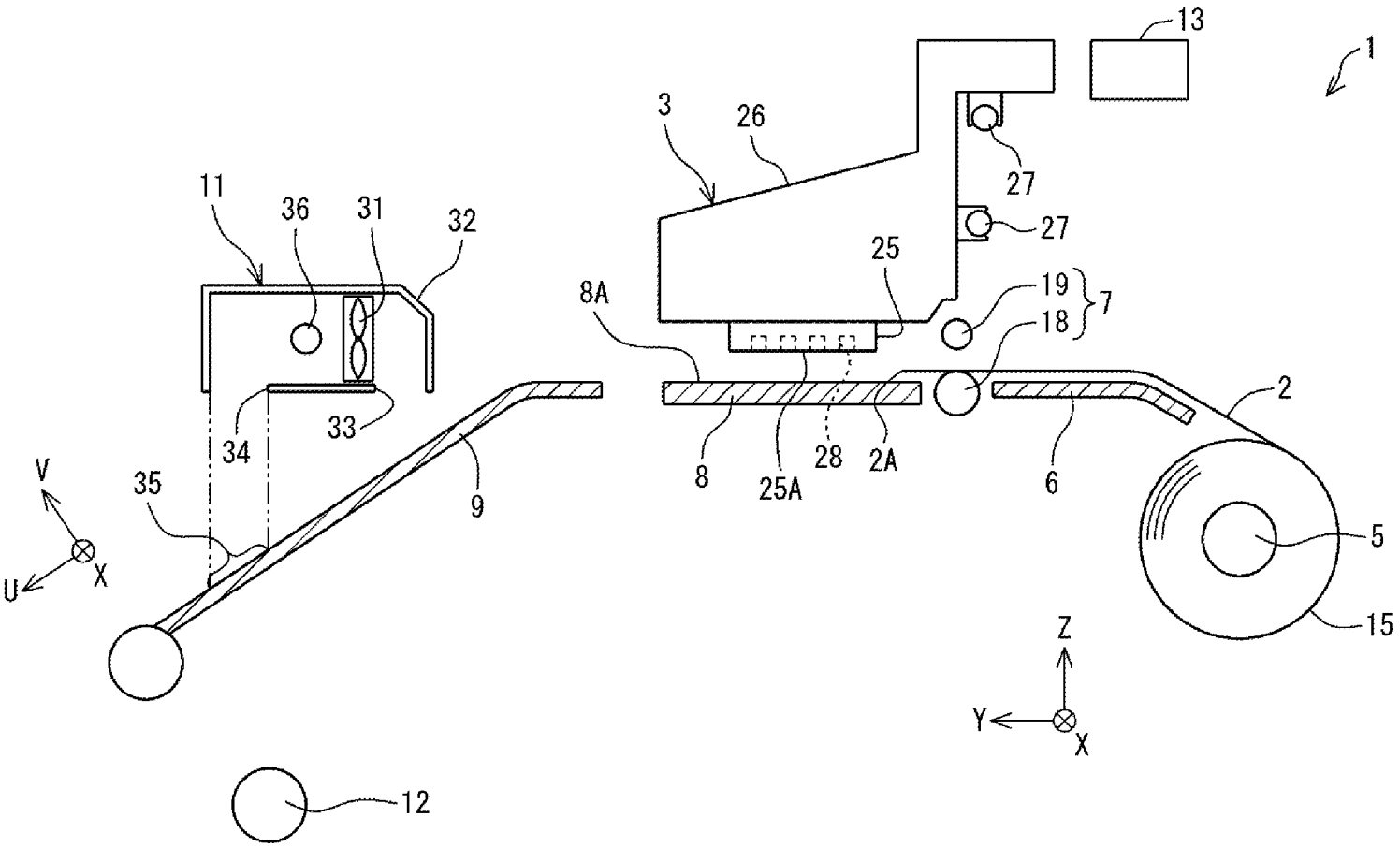
FIG. 3 is a schematic cross-sectional view illustrating the configuration of the printing apparatus.

When the roll 15 is set at the feeding shaft 5 of the printing apparatus 1, nipping of the first roller 18 and the second roller 19 is released, as illustrated in FIG. 3. Releasing the nipping state is performed by lifting the second roller 19. Upon release of the nipping of the first roller 18 and the second roller 19, a detection signal is transmitted from the nipping releasing sensor 54 to the controlling unit 13. The detection signal from the nipping releasing sensor 54 at this time indicates a result of detection indicating that nipping is released. In a state where nipping of the first roller 18 and the second roller 19 is released, the leading end 2A of the medium 2 is caused to pass through between the first roller 18 and the second roller 19.

Figure 4:
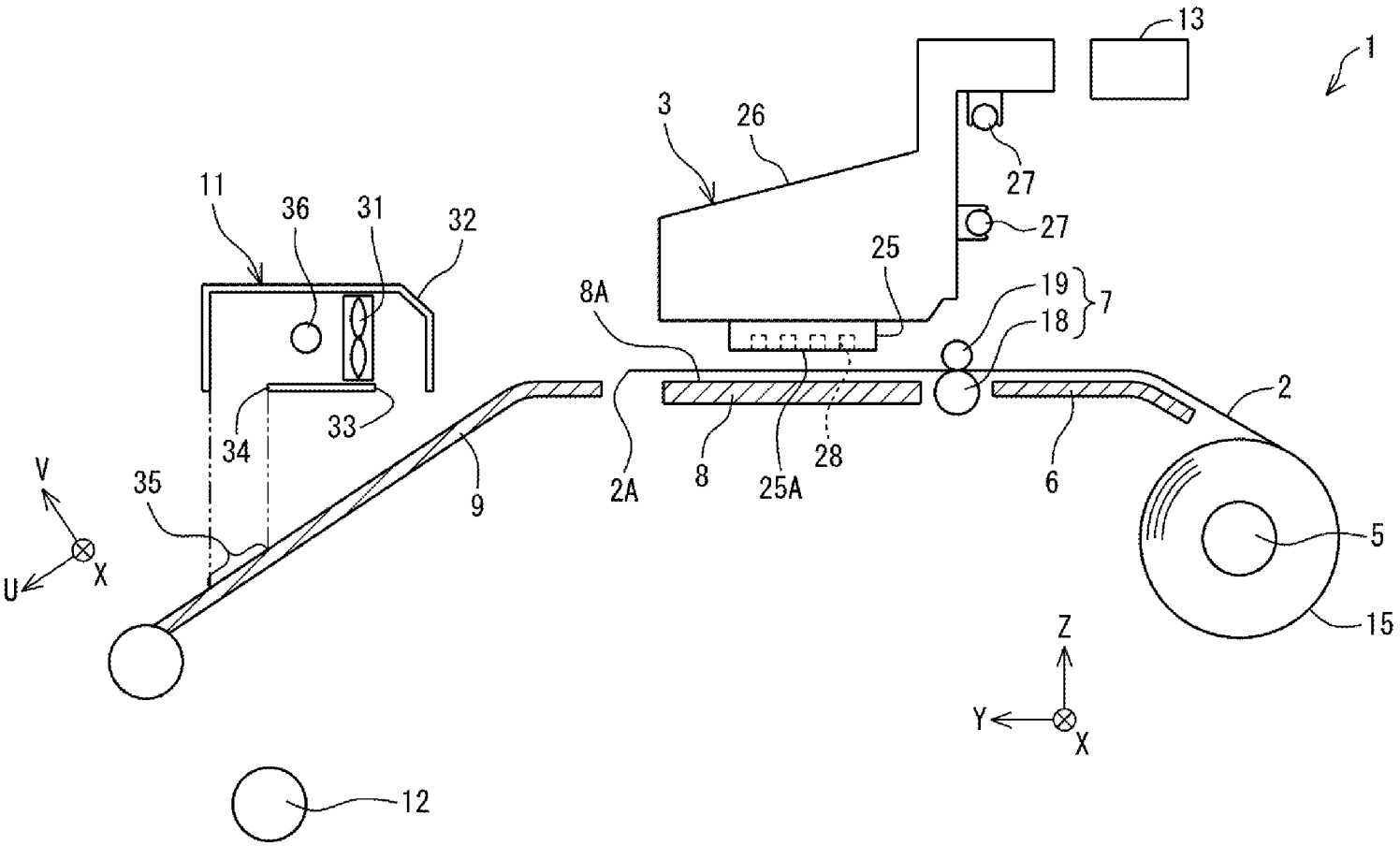
FIG. 4 is a schematic cross-sectional view illustrating the configuration of the printing apparatus.

Next, a user turns the first roller 18 and the second roller 19 into the nipping state, as illustrated in FIG. 4. At this time, the detection signal transmitted from the nipping releasing sensor 54 to the controlling unit 13 indicates a result of detection that the first roller 18 and the second roller 19 are in the nipping state. Next, the user gives the printing apparatus 1 an instruction to transport the medium 2. At this time, the user gives the instruction to transport the medium 2, for example, through an operating panel of the printing apparatus 1. Next, after checking that the medium 2 is transported to the support face 8A of the second support portion 8, the user gives an instruction to perform a print job. This makes it possible to start printing on the basis of the print job.

Figure 5:
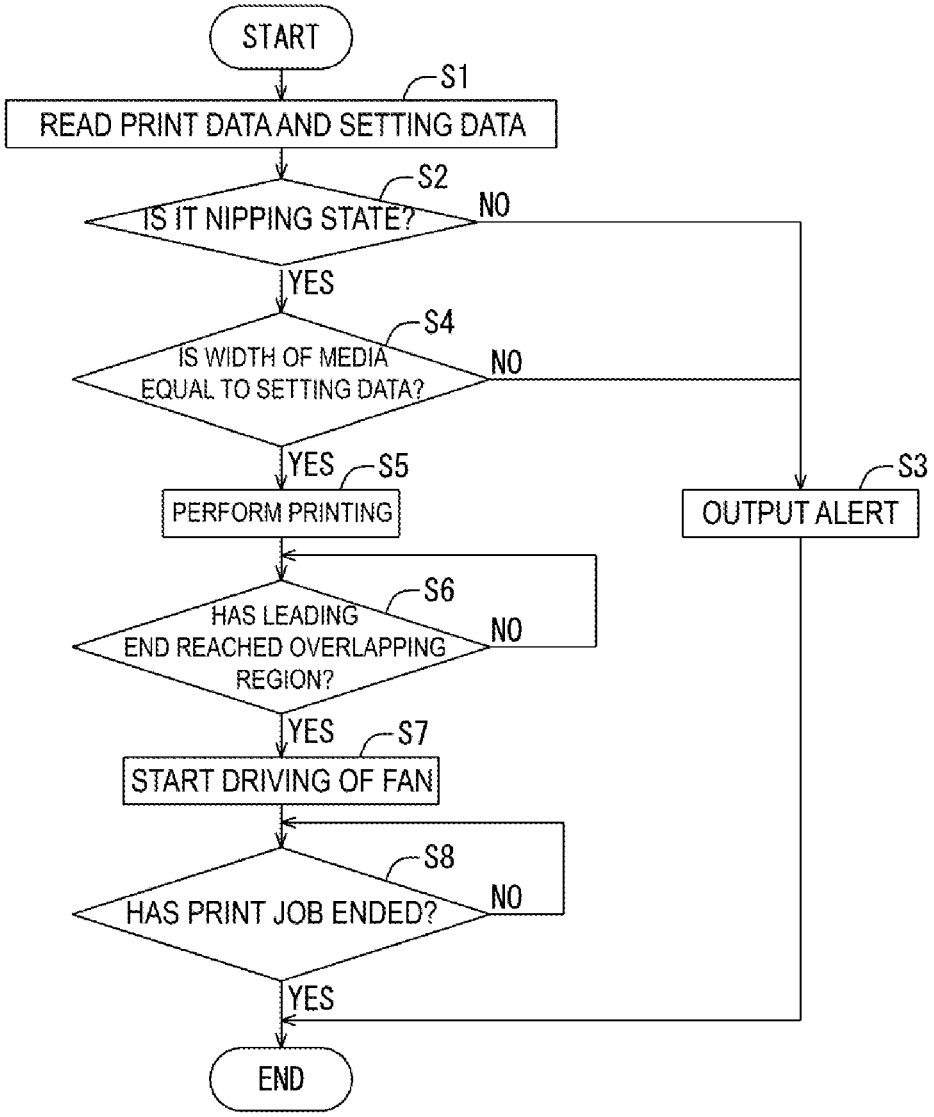
FIG. 5 is a flowchart showing a flow of a printing process.

Upon the instruction being given by the user to perform the print job, the computing unit 41 performs a printing process illustrated in FIG. 5. In the printing process, print data and setting data are first read in step S1. The print data and the setting data are data included in the print job. Next, in step S2, determination is made as to whether or not a result of detection by the nipping releasing sensor 54 is a result indicating the nipping state. When determination is made as NO in step S2, an alert is outputted in step S3, and the process ends. When determination is made as YES in step S2, the process proceeds to step S4.

In step S4, determination is made as to whether or not a result of detection by the medium-width detecting sensor 55 matches setting data. When determination is made as NO in step S4, an alert is outputted in step S3, and the process ends. When determination is made as YES in step S4, the process proceeds to step S5. In step S5, printing based on print data is performed. Next, in step S6, determination is made as to whether or not the leading end 2A of the medium 2 reaches the overlapping region 35. When determination is made as NO in step S6, the process of step S6 repeats until the leading end 2A reaches the overlapping region 35. When determination is made as YES in step S6, the process proceeds to step S7.

In step S7, driving the fan 31 is caused to start. Next, in step S8, determination is made as to whether or not the print job ends. When determination is made as NO in step S8, the process of step S8 repeats until the print job ends. When determination is made as YES in step S8, the process ends the printing process. With the printing apparatus 1, after the leading end 2A of the medium 2 reaches the overlapping region 35, driving of the fan 31 starts. The printing method in which driving of the fan 31 starts after the leading end 2A of the medium 2 reaches the overlapping region 35 is referred to as a blow-controlled printing method.

In the printing apparatus 1, the blow-controlled printing method illustrated in FIG. 5 is applied. With the printing apparatus 1, when airflow from the blow port 34 is blown against the leading end 2A of the medium 2 with driving of the fan 31, the medium 2 is pressed toward the transport path due to the airflow. In other words, due to the airflow from the blow port 34, the medium 2 is pressed toward a reverse direction to a direction in which the medium moves away from the transport path. This makes it easy to prevent the medium 2 from being lifted from the transport path. Thus, it is possible to easily prevent the medium 2 from getting stuck.

In addition, with the printing apparatus 1, printing can be performed before the leading end 2A of the medium 2 is wound around the winding shaft 12. This makes it possible to reduce a waste of the medium 2. In a case where, when the roll 15 is set at the feeding shaft 5, the leading end 2A of the medium 2 is caused to be wound around the winding shaft 12 and then printing is started, printing is not performed from the second support portion 8 to the winding shaft 12 in the transport path. In this situation, in a case of the printing apparatus 1, printing can be performed before the leading end 2A is wound around the winding shaft 12. This makes it possible to reduce a waste of the medium 2.

Note that whether or not the leading end 2A of the medium 2 reaches the overlapping region 35 can be determined, for example, on the basis of the position of the printing region. That is, after printing starts in step S5, the computing unit 41 can determine that the leading end 2A reaches the overlapping region 35, on the basis of a determination that a printing region of the medium 2 in which printing has been performed reaches the overlapping region 35. The leading end 2A of the medium 2 is disposed downstream of the printing region. Thus, when the printing region reaches the overlapping region 35, the leading end 2A of the medium 2 also reaches the overlapping region 35. For this reason, with this printing apparatus 1, driving of the fan 31 is caused to start on the basis of the fact that the printing region reaches the overlapping region 35. This makes it easy to prevent the medium 2 from being lifted from the transport path. Thus, it is possible to easily prevent the medium 2 from getting stuck.

In addition, whether or not the printing region reaches the overlapping region 35 can be determined, for example, on the basis of the amount of transporting of the medium 2. It is possible to grasp the amount of transporting of the medium 2 on the basis of the amount of driving of the transport motor 52. In other words, the computing unit 41 is able to determine that the leading end 2A reaches the overlapping region 35, on the basis of the amount of transporting of the medium 2 from a time when printing starts in step S5. With this printing apparatus 1, it is possible to determine that the printing region reaches the overlapping region 35, on the basis of the amount of transporting of the medium 2 from a time when printing by the printing unit 3 starts.

Figure 6:
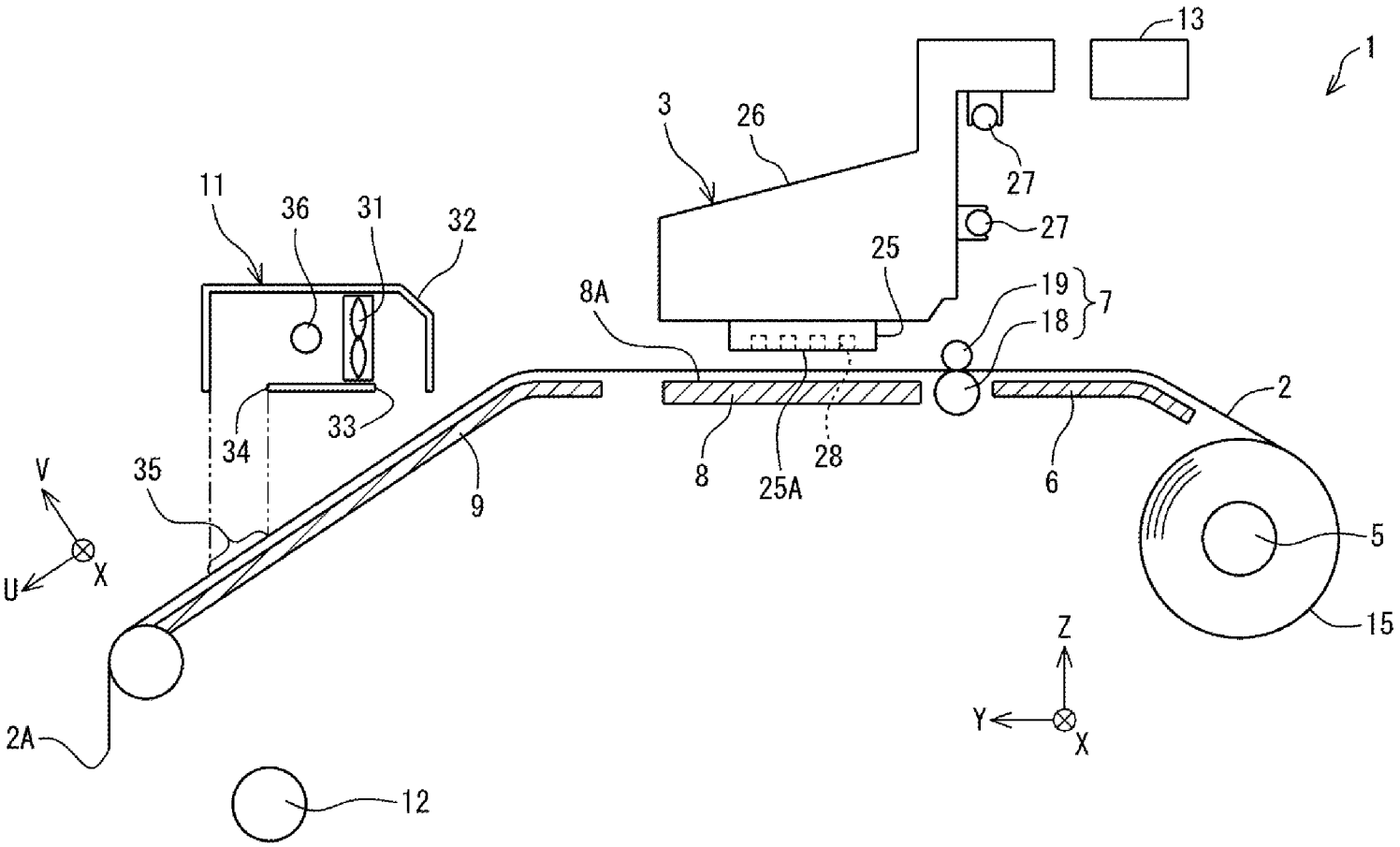
FIG. 6 is a schematic cross-sectional view illustrating the configuration of the printing apparatus.

Whether or not the blow-controlled printing method can be applied can be determined on the basis of the fact that the leading end 2A is not wound around the winding shaft 12. It can be considered that a user gives an instruction of a print job in a state in which the leading end 2A is not wound around the winding shaft 12 as illustrated in FIG. 6. Whether or not the leading end 2A is wound around the winding shaft 12 can be determined on the basis of a result of detection by the electric current sensor 58 illustrated in FIG. 2. The load acting on the winding motor 57 when the leading end 2A is in a state of being wound around the winding shaft 12 is greater than the load acting on the winding motor 57 when the leading end 2A is not wound around the winding shaft 12. Thus, it is possible to determine whether or not the leading end 2A is wound around the winding shaft 12, on the basis an electric current value of the transport motor 52 detected by the electric current sensor 58.

Figure 7:
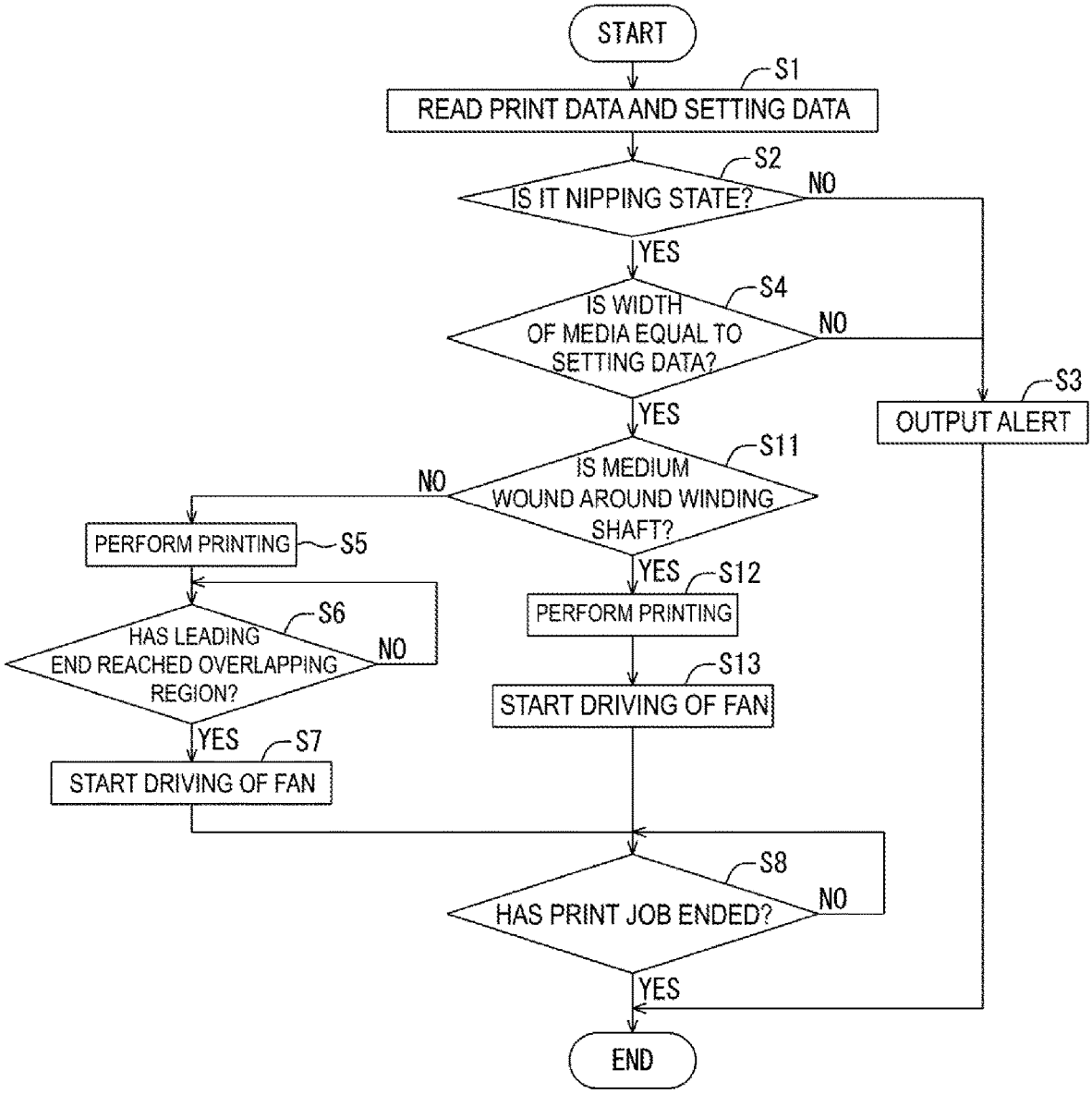
FIG. 7 is a flowchart showing a flow of a printing process.

As illustrated in FIG. 7, the computing unit 41 determines whether or not the medium 2 is wound around the winding shaft 12, in step S11. Whether or not the medium 2 is wound around the winding shaft 12 is determined on the basis of a result of determination of an electric current value by the electric current sensor 58 described above. When the result of determination by the electric current sensor 58 exceeds a predetermined electric current value, it is determined that the medium 2 is wound around the winding shaft 12. Note that, in FIG. 7, the same reference characters are attached to the same processes as those in FIG. 5, and detailed explanation thereof will not be made.

When determination is made as NO in step S11, the process proceeds to step S5. Next, processes from step S5 to step S8 are performed, and then, the process ends. The processes from step S5 to step S8 are the same processes as those in FIG. 5. When determination is made as YES in step S11, the process proceeds to step S12. In step S12, printing based on print data is performed. Next, driving of the fan 31 is caused to start in step S13, and then the process proceeds to step S8.

With this printing apparatus 1, when printing is started in a state in which the medium 2 is not wound around the winding shaft 12, the printing unit 3 starts printing, and after the leading end 2A of the medium 2 reaches the overlapping region 35, driving of the fan 31 starts. Here, it is possible to determine that the leading end 2A reaches the overlapping region 35, on the basis of a fact that the printing region of the medium 2 on which printing has been performed reaches the overlapping region 35. This makes it easy to prevent the medium 2 from being lifted from the transport path. Thus, it is possible to easily prevent the medium 2 from getting stuck. In addition, in the flow shown in FIG. 7, in a case where printing is started in a state in which the medium 2 is wound around the winding shaft 12, the computing unit 41 causes driving of the fan 31 to start when printing by the printing unit 3 starts. This makes it possible to accelerate drying of the ink attached on the medium 2. Note that FIG. 7 shows a flow in which, after printing starts in step S12, driving of the fan 31 starts in step S13. However, the order of flow is not limited to this. It may be possible to employ a flow in which driving of the fan 31 starts in step S12, and then, printing starts in step S13.

Figure 8:
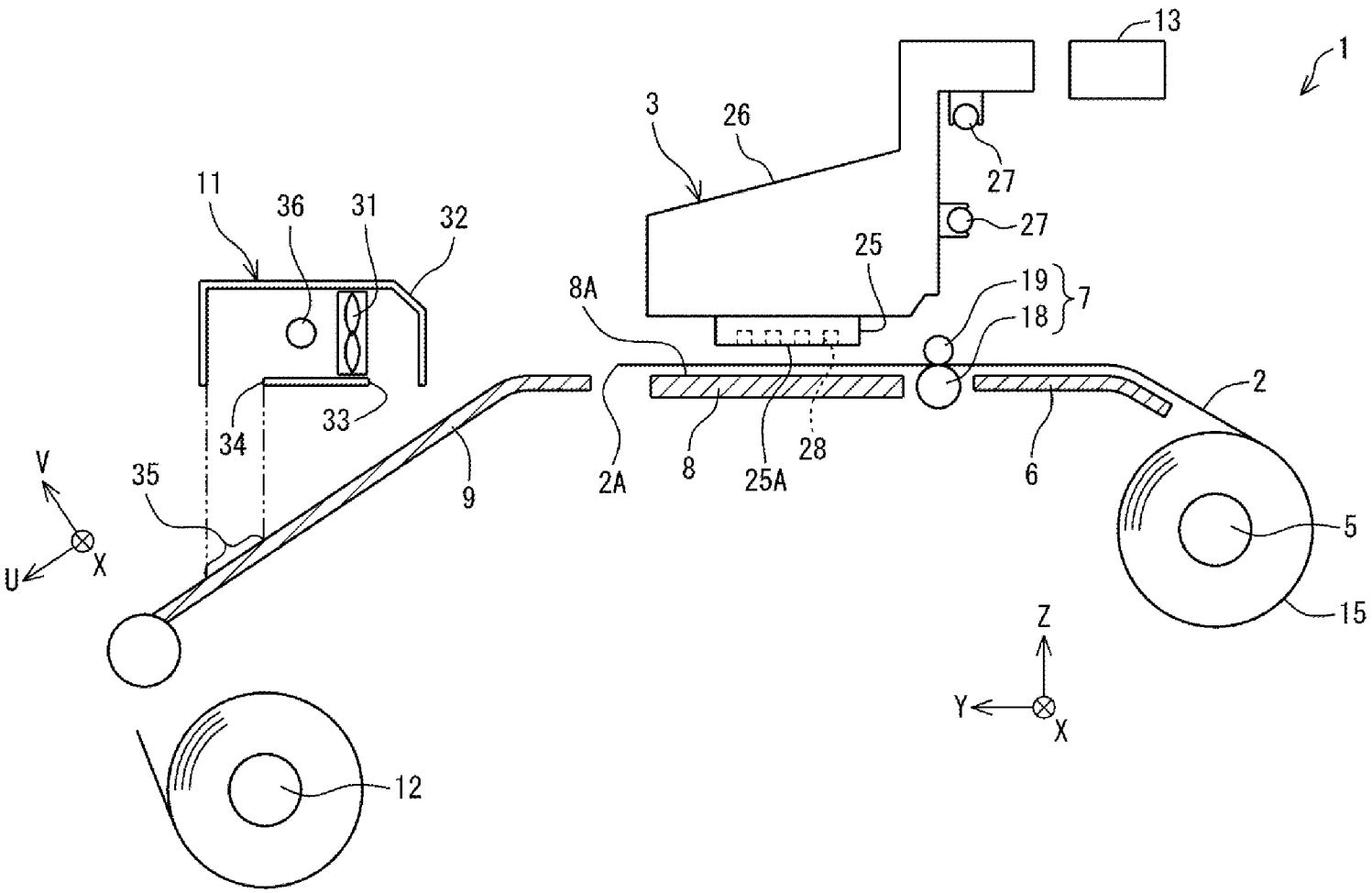
FIG. 8 is a schematic cross-sectional view illustrating the configuration of the printing apparatus.
Figure 9:
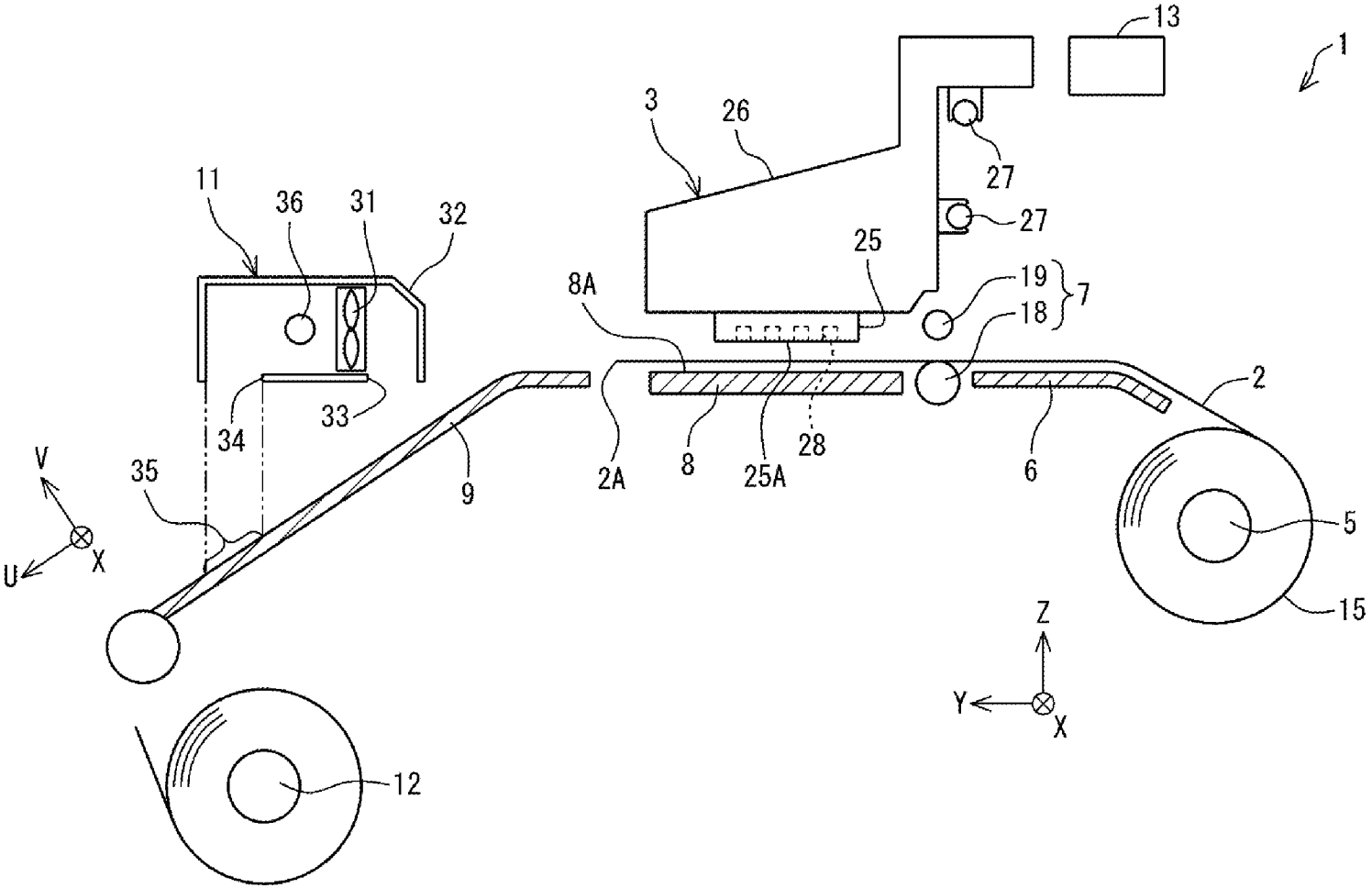
FIG. 9 is a schematic cross-sectional view illustrating the configuration of the printing apparatus.

In the printing apparatus 1, when the medium 2 fed from the roll 15 is transported along the transport path, wrinkle or wave may occur in the medium 2. In such a case, the medium 2 may be cut between the second support portion 8 and the winding shaft 12, as illustrated in FIG. 8. In addition, wrinkle or wave may be corrected in a state in which nipping of the first roller 18 and the second roller 19 is released, as illustrated in FIG. 9. After wrinkle or wave is corrected, a user returns the first roller 18 and the second roller 19 into the nipping state.

At this time, when the medium 2 wound around the winding shaft 12 exists, a load acts on the transport motor 52. Thus, a result of detection by the electric current sensor 58 may be a result in which the medium 2 is wound around the winding shaft 12. However, the leading end 2A of the medium 2 is located between the second support portion 8 and the winding shaft 12. When the leading end 2A is located upstream of the overlapping region 35, the medium 2 may be lifted from the transport path due to air blown by the blowing device 11.

Figure 10:
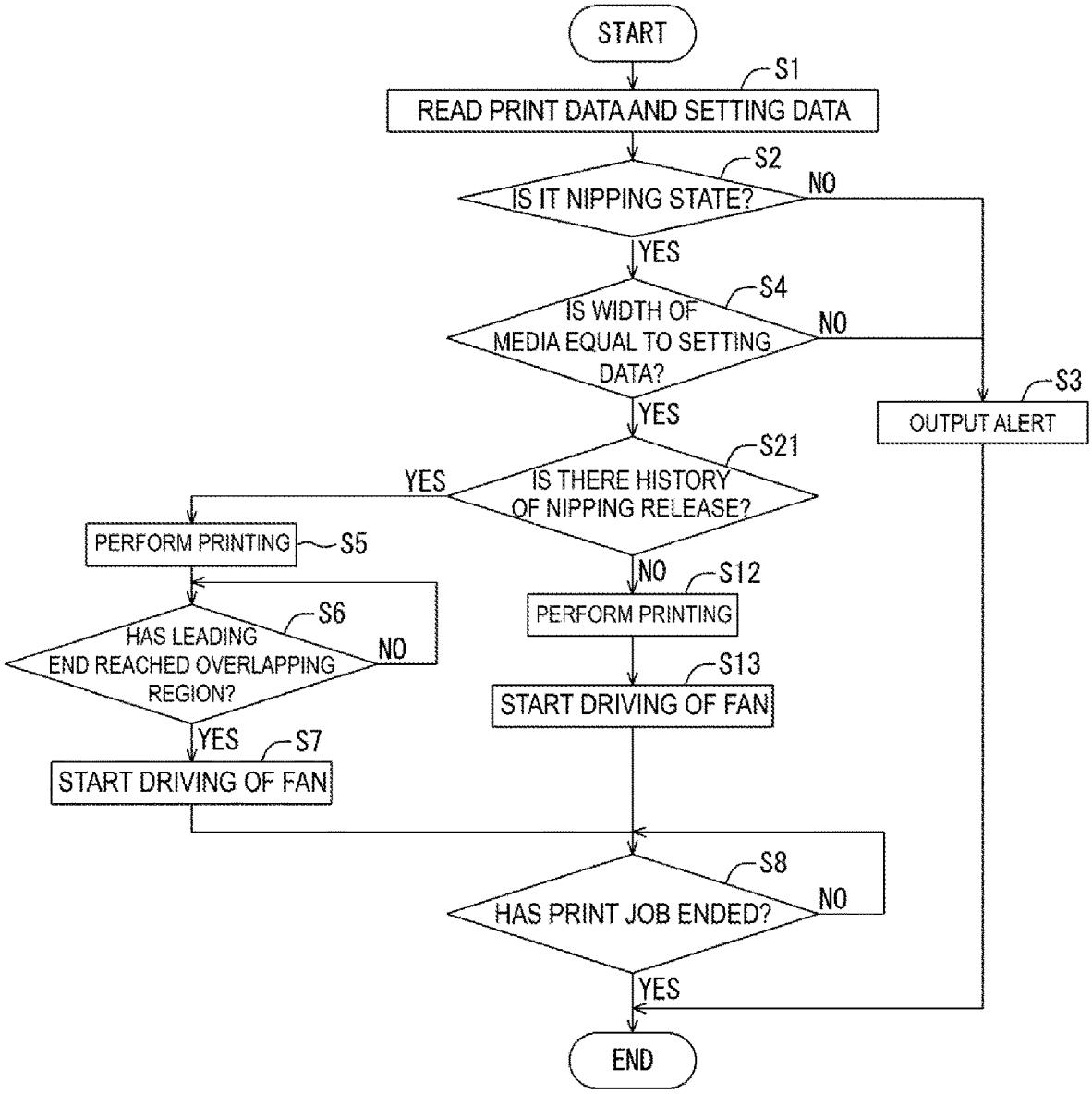
FIG. 10 is a flowchart showing a flow of a printing process.

Thus, the printing apparatus 1 records a history that nipping is released after the immediately preceding blow-controlled printing process. The history that nipping is released is referred to as a nipping release history. When the nipping release history is recorded, the printing apparatus 1 applies the blow-controlled printing method. The computing unit 41 determines, in step S21, whether or not a nipping release history exists, as illustrated in FIG. 10. Note that, in FIG. 10, the same reference characters are attached to the same processes as those in FIG. 7, and detailed explanation thereof will not be made. When determination is made as YES in step S21, the process proceeds to step S5. Next, processes from step S5 to step S8 are performed, and then, the process ends. The processes from step S5 to step S8 are the same processes as those in FIG. 7.

When determination is made as NO in step S21, the process proceeds to step S12. In step S12, printing based on print data is performed. Next, driving of the fan 31 is caused to start in step S13, and then, the process proceeds to step S8. With this printing apparatus 1, the blow-controlled printing process is performed when printing is started in a state in which change is made from a state in which medium 2 is not interposed between the first roller 18 and the second roller 19, into a state in which the medium 2 is interposed. With this configuration, in the printing apparatus 1, printing by the printing unit 3 starts, and driving of the fan 31 starts after the leading end 2A of the medium 2 reaches the overlapping region 35. This makes it easy to prevent the medium 2 from being lifted from the transport path. Thus, it is possible to easily prevent the medium 2 from getting stuck. In addition, in the flow illustrated in FIG. 10, when printing is started without change from the state in which the medium 2 is not interposed between the first roller 18 and the second roller 19, into the state in which the medium 2 is interposed, the computing unit 41 causes driving of the fan 31 to be started when printing by the printing unit 3 is started. This makes it possible to accelerate drying of the ink attached on the medium 2. Note that the nipping release history is reset after step S8.

Note that, in the printing apparatus 1, it may be possible to apply a flow in which the blow-controlled printing process is performed when printing is started in a state in which the medium 2 is not wound around the winding shaft 12 and a nipping release history is recorded. This makes it easy to prevent the medium 2 from being lifted from the transport path. Thus, it is possible to easily prevent the medium 2 from getting stuck.

Figure 11:
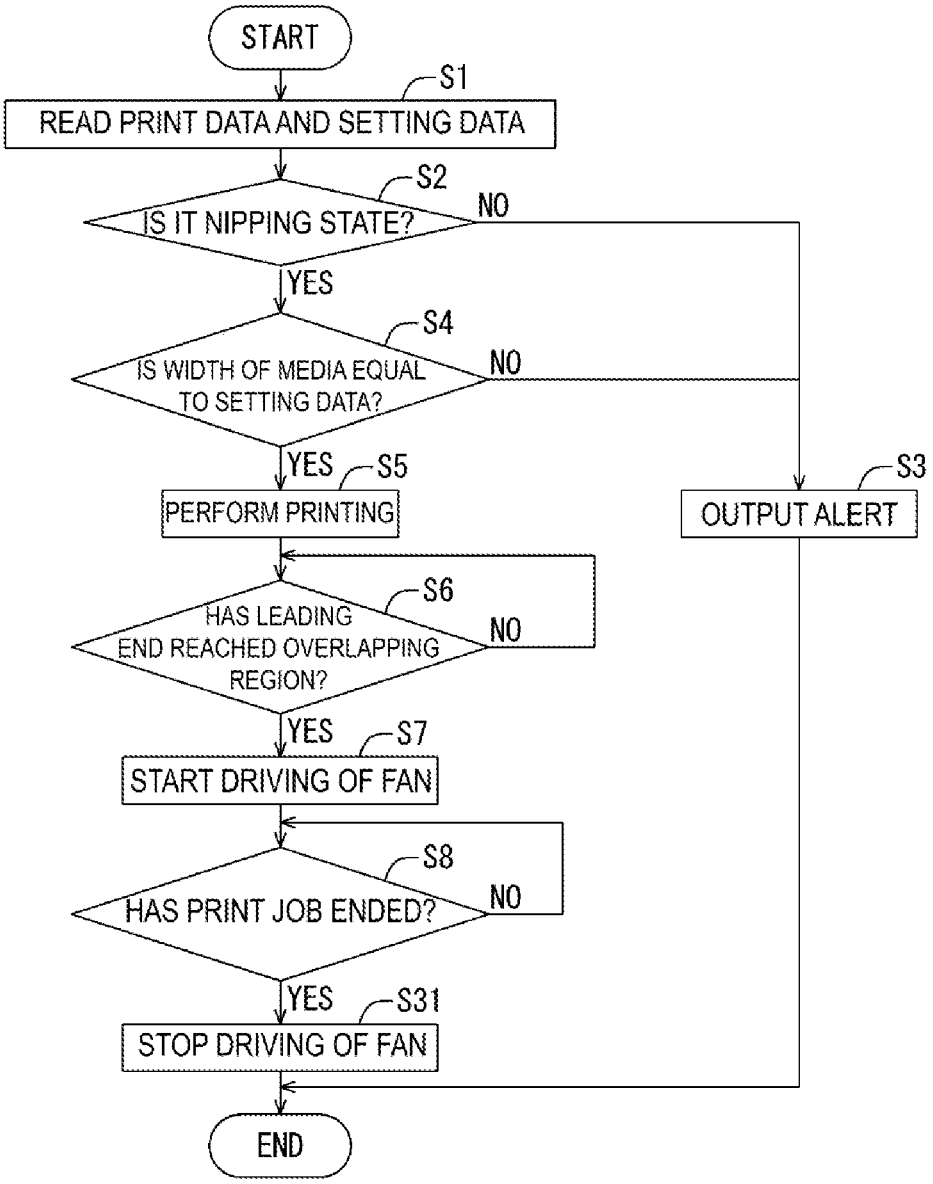
FIG. 11 is a flowchart showing a flow of a printing process.

In addition, in the printing apparatus 1, it may be possible to employ a flow in which a process of step S31 is performed after step S8, as illustrated in FIG. 11. In the printing apparatus 1, after determining in step S8 that a print job ends, the computing unit 41 stops driving of the fan 31 in step S31. With this printing apparatus 1, it is possible to reduce consumption of power necessary to drive the fan 31. Note that it may be possible to stop driving of the fan 31 immediately after printing based on the print job ends. In addition, it may be possible to employ a configuration in which driving of the fan 31 is stopped after printing based on the print job ends and the printing region passes through the overlapping region 35. By using a method of stopping driving of the fan 31 after the printing region passes through the overlapping region 35, it is possible to stop driving of the fan 31 after the printing region is dried.

What is claimed is:

1. A printing apparatus comprising:

a feeding portion configured to feed a medium from a roll around which the medium is wound;

a transport unit configured to transport, along a transport path, the medium fed from the feeding portion;

a printing unit opposed from the transport path downstream of the feeding portion in the transport path and configured to discharge a liquid toward the medium to perform printing on the medium;

an air blowing unit disposed downstream of the printing unit in the transport path and configured to blow air toward the medium;

a winding unit configured to wind the medium downstream of the printing unit in the transport path; and a control unit configured to control blowing air by the air blowing unit, wherein the air blowing unit includes a fan configured to generate airflow and a case configured to accommodate the fan, the case includes a blow port open toward the transport path, after the printing unit starts printing on the medium, the control unit starts driving the fan when a leading end of the medium fed from the feeding portion reaches an overlapping region that overlaps with the blow port as viewed toward air blown from the blow port, the control unit starts driving of the fan on a basis of a determination that, after the printing by the printing unit starts, a printing region of the medium on which printing is performed reaches the overlapping region, when printing is started in a state in which the medium is not wound around the winding unit, the control unit starts driving of the fan on a basis of a determination that, after printing by the printing unit is started, the printing region reaches the overlapping region, and when the printing is started in a state in which the medium is wound around the winding unit, the control unit starts driving of the fan when printing by the printing unit is started.

2. The printing apparatus according to claim 1, wherein the transport unit includes a first roller and a second roller disposed at sides that are opposed to each other with the transport path being interposed between the first roller and the second roller, the first roller and the second roller are disposed between the feeding portion and the printing unit, and are configured to rotate in a state in which the medium is interposed between the first roller and the second roller to transport the medium, when the printing is started after a change is made from a state in which the medium is not interposed between the first roller and the second roller, into a state in which the medium is interposed, the control unit causes the printing unit to start the printing, and causes driving of the fan to start after the leading end of the medium reaches the overlapping region, and when the printing is started without changing from a state in which the medium is not interposed between the first roller and the second roller, into a state in which the medium is interposed, the control unit causes driving of the fan to be started when the printing by the printing unit is started.

3. The printing apparatus according to claim 1, wherein the control unit determines that the printing region reaches the overlapping region, on a basis of an amount of transporting of the medium from a time when the printing by the printing unit starts.

4. The printing apparatus according to claim 1, wherein after the printing by the printing unit ends and then the printing region passes through the overlapping region, the control unit stops driving of the fan.

5. A printing apparatus comprising:

a feeding portion configured to feed a medium from a roll around which the medium is wound;

a transport unit configured to transport, along a transport path, the medium fed from the feeding portion;

a printing unit opposed from the transport path downstream of the feeding portion in the transport path and configured to discharge a liquid toward the medium to perform printing on the medium;

an air blowing unit disposed downstream of the printing unit in the transport path and configured to blow air toward the medium;

a winding unit configured to wind the medium downstream of the printing unit in the transport path; and a control unit configured to control blowing air by the air blowing unit, wherein the air blowing unit includes a fan configured to generate airflow and a case configured to accommodate the fan, the case includes a blow port open toward the transport path, and after the printing unit starts printing on the medium and a leading end of the medium fed from the feeding portion reaches an overlapping region that overlaps with the blow port as viewed toward air blown from the blow port, the control unit starts driving the fan, wherein when printing is started in a state in which the medium is not wound around the winding unit, the control unit starts driving of the fan on a basis of a determination that, after printing by the printing unit is started, the leading end of the medium reaches the overlapping region, and when the printing is started in a state in which the medium is wound around the winding unit, the control unit starts driving of the fan when printing by the printing unit is started.

6. A printing apparatus comprising:

a feeding portion configured to feed a medium from a roll around which the medium is wound;

a transport unit configured to transport, along a transport path, the medium fed from the feeding portion;

a printing unit opposed from the transport path downstream of the feeding portion in the transport path and configured to discharge a liquid toward the medium to perform printing on the medium;

an air blowing unit disposed downstream of the printing unit in the transport path and configured to blow air toward the medium; and a control unit configured to control blowing air by the air blowing unit, wherein the air blowing unit includes a fan configured to generate airflow and a case configured to accommodate the fan, the case includes a blow port open toward the transport path, and after the printing unit starts printing on the medium and a leading end of the medium fed from the feeding portion reaches an overlapping region that overlaps with the blow port as viewed toward air blown from the blow port, the control unit starts driving the fan, wherein the transport unit includes a first roller and a second roller disposed at sides that are opposed to each other with the transport path being interposed between the first roller and the second roller, the first roller and the second roller are disposed between the feeding portion and the printing unit, and are configured to rotate in a state in which the medium is interposed between the first roller and the second roller to transport the medium, when the printing is started after a change is made from a state in which the medium is not interposed between the first roller and the second roller, into a state in which the medium is interposed, the control unit causes the printing unit to start the printing, and causes driving of the fan to start after the leading end of the medium reaches the overlapping region, and when the printing is started without changing from a state in which the medium is not interposed between the first roller and the second roller, into a state in which the medium is interposed, the control unit causes driving of the fan to be started when the printing by the printing unit is started.

* * * * *